US005888315A

United States Patent [19]

Ishii et al.

[11] Patent Number: 5,888,315

[45] Date of Patent: Mar. 30, 1999

[54] COMPOSITION AND PROCESS FOR FORMING AN UNDERPAINT COATING ON METALS

[75] Inventors: Hitoshi Ishii; Yasuhiko Nagashima, both of Hiratsuka, Japan

[73] Assignee: Henkel Corporation, Gulph Mills, Pa.

[21] Appl. No.: 913,041

[22] PCT Filed: Mar. 5, 1996

[86] PCT No.: PCT/US96/02677

§ 371 Date: Sep. 5, 1997

§ 102(e) Date: Sep. 5, 1997

[87] PCT Pub. No.: WO96/27692

PCT Pub. Date: Sep. 12, 1996

[30] Foreign Application Priority Data

Mar. 7, 1995 [JP] Japan ..... 7-047605

[51] Int. Cl.[6] ..... C23C 22/07

[52] U.S. Cl. ..... 148/259; 148/262; 148/273

[58] Field of Search ..... 148/259, 262, 148/273

[56] References Cited

U.S. PATENT DOCUMENTS

| | | | |
|---|---|---|---|
| 2,471,908 | 5/1949 | Snyder | 148/259 |
| 4,142,917 | 3/1979 | Yashiro et al. | 148/262 |
| 4,171,231 | 10/1979 | Bishop et al. | 148/258 |
| 4,233,087 | 11/1980 | Cooke | 148/262 |
| 4,517,030 | 5/1985 | Yamamoto et al. | 148/6.15 R |
| 5,312,492 | 5/1994 | Riesop et al. | 148/262 |
| 5,516,372 | 5/1996 | Riesop et al. | 148/262 |

FOREIGN PATENT DOCUMENTS

| | | |
|---|---|---|
| 0414296 | 2/1991 | European Pat. Off. . |
| 2365642 | 4/1978 | France . |
| 2410055 | 6/1979 | France . |
| 62-009190 | 2/1987 | Japan . |
| 63-018084 | 1/1988 | Japan . |
| 828916 | 2/1960 | United Kingdom . |
| 96 17976 | 6/1996 | WIPO . |
| 96 27693 | 9/1996 | WIPO . |

*Primary Examiner*—David A. Simmons
*Assistant Examiner*—Robert R. Koehler
*Attorney, Agent, or Firm*—Wayne C. Jaeschke; Norvell E. Wisdom, Jr.; Lance G. Johnson

[57] ABSTRACT

A zinc phosphating composition containing organoperoxide along with zinc ions and phosphate ions forms finely crystalline, dense, and thin conversion coatings on metal surfaces that are normally zinc phosphate conversion coated, even at coating temperatures below 50° C. and without any "conditioning" of the surface before conversion coating by contact of the surface to be conversion coated with a conventional colloidal suspension of titanium salts.

23 Claims, No Drawings

COMPOSITION AND PROCESS FOR FORMING AN UNDERPAINT COATING ON METALS

TECHNICAL FIELD

This invention relates to a surface treatment method that can be applied to various types of metals to form thereon an undercoating film usable with a variety of paint systems. More specifically, this invention relates to a surface treatment method of the described type that, without using a titanium colloid surface-conditioning treatment: (a) produces a dense, fine, and uniform conversion film; (b) induces the formation of fine-sized crystals in the conversion film; and (c) forms a high quality underpaint coating for electrodeposition painting, solvent based painting, powder coating, and the like.

BACKGROUND ART

Zinc phosphate conversion treatments and chromate treatments are currently in widespread use as underpaint coating treatments for various types of metals for the purpose of improving the post-painting corrosion resistance and paint film adherence. Zinc phosphate conversion treatments are mainly used when the metal substrate is composed of iron or is a composite of several types of materials, because it is difficult for chromate treatments to accommodate or be adapted to such substrates.

The crystals in the films afforded by zinc phosphate conversion treatment are subject to substantial variation in size as a function of the treatment conditions. Thick coatings of coarse crystals are ideal for plastic-working operations and rust prevention, but when such coatings are painted they may fail to provide a satisfactory paint film adherence. In fact, the most demanding uses of zinc phosphate conversion coatings as underpaint coatings require the generation of thin conversion films of uniform, dense, and fine coating crystals.

Two general methods are known for generating thin zinc phosphate conversion coatings. In one method, contact with the conversion treatment bath is suspended after only partial completion of the film-deposition reactions, thereby stopping these reactions. A problem with this method is that it gives an incomplete deposition of the conversion film and thus fails to provide complete coverage of the basis metal. As a result, post-conversion water rinse and drying processes can cause the substrate to rust, and the post-painting corrosion resistance will also be unsatisfactory.

The other general method relies on inducing fine-sized coating crystals. In this method the film-deposition reactions spontaneously terminate, or at least greatly slow, while the film is still thin, and the completed conversion coating completely covers the substrate. This method can provide both a satisfactory paint film adherence and post-painting corrosion resistance.

Immersion and spraying techniques are primarily used in the above described zinc phosphate conversion treatment technologies. In the absence of a prior "conditioning" treatment of the metal surfaces to be coated, immersion does not usually produce dense, fine coating crystals and requires a lengthy period of time for conversion treatment unless the treatment temperature is 55° C. or greater. Spraying does produce a somewhat better fine-crystal formation in the coating than does immersion, but not usually enough to provide a fully satisfactory painting performance. And again, treatment temperatures of at least 55° C. are required in order to complete the treatment in a relatively brief period of time.

A titanium colloid surface-conditioning treatment must usually be applied to the metal surface immediately prior to conversion treatment in order to obtain (a) fine-crystal formation in the coating and (b) a reduction in the treatment temperature to 50° C. and below. This surface-conditioning treatment activates the surface of the metal substrate, with the result that, regardless of the use of immersion or spraying, the treatment temperature can be lowered, the treatment time can be shortened, and a fine-sized crystalline film that provides an entirely satisfactory painting performance can be obtained.

When metal surfaces are subjected to a zinc phosphate conversion treatment for the above-described purpose of providing an underpaint coating, the surface is ordinarily subjected to a titanium colloid surface-conditioning treatment immediately prior to the conversion treatment process. However, the titanium colloid dispersed in the surface-conditioning treatment bath aggregates with elapsed time after bath preparation, leading to a decline in the surface-conditioning activity with continued time of use. Japanese Patent Publication Number Sho 62-9190 [9,190/1987] teaches management of the $Mg/P_2O_7$ ratio in the surface-conditioning treatment bath in order to increase the stability of the titanium colloid, while Japanese Patent Application Laid Open [Kokai or Unexamined] Number Sho 63-18084 [18,084/1988] discloses the addition to the surface-conditioning treatment bath of an organic material as a stabilizer for the titanium colloid. Each of these methods, however, is less effective than would be desirable, with the result that in practice aged bath must be discharged and freshly prepared bath must be supplied on a continuous or at least frequent basis in order to cope with the decline in activity. This preparation and management of the surface-conditioning treatment bath is complex and labor intensive and entails a major economic burden due to its high reagent consumption. And of course, because treatment facilities are required in order to implement the surface-conditioning treatment, this raises costs for maintenance of the facilities and an expansion of the treatment space.

As a consequence of the various issues discussed above, there has recently been strong demand for the development of a surface treatment method that could omit the problematic titanium colloid surface-conditioning treatment while still being able to form on metal surfaces the uniform, fine, dense, and thin conversion films that are optimal as underpaint coatings.

DISCLOSURE OF THE INVENTION

Problems to Be Solved by the Invention

This invention was developed in order to solve the above-described problems that occur with the surface-conditioning treatment that is run immediately prior to zinc phosphate conversion treatment. In specific terms, this invention introduces a surface treatment method for the formation of underpaint coatings on metals, wherein said method, without the use of a surface-conditioning treatment, can form on the surface of various metals a uniform, fine, and dense conversion coating that provides an excellent paintability and is also able to generate fine-sized crystals in the conversion coating.

SUMMARY OF THE INVENTION

It has been found that the use of a heretofore unexamined organic oxidizing agent, namely, organoperoxide, led to the deposition of a uniform, thin, finely crystalline, and dense conversion coating on the surfaces of metal substrates—and thereby yielded an excellent painting performance—even when zinc phosphate conversion treatment was used on the metal surface directly after cleaning without any intervening surface-conditioning treatment. It was also discovered at the same time that the surface treatment method according to the present invention afforded the desired effects to a satisfactory degree even at relatively low conversion coating temperatures.

In specific terms, then, the surface treatment method according to the present invention for the formation of underpaint coatings on metals characteristically comprises the formation of a conversion coating on metal surfaces by first cleaning the surface of the metal and, without any surface conditioning treatment as is conventionally performed, thereafter bringing the said clean surface into contact with a zinc phosphate conversion treatment bath that contains zinc ions, phosphate ions, and organoperoxide.

No particular restrictions apply to the type, shape, or dimensions of metals that may be treated by the method according to the present invention. For example, the method according to the present invention can be applied to a variety of iron and steel materials, for example, steel sheet and zinciferous metal-plated steel sheet, and to a variety of aluminum materials, for example, aluminum sheet and aluminum alloys such as aluminum-magnesium alloys and aluminum-silicon alloys.

DETAILED DESCRIPTION OF THE INVENTION AND ITS PREFERRED EMBODIMENTS

The organoperoxide concentration in the subject conversion treatment bath is preferably from 50 to 1,500 ppm, and the temperature of the conversion treatment bath is preferably from 25° C. to 50° C.

The surface treatment method according to the present invention requires that the zinc phosphate conversion treatment be executed on a clean metal surface. Accordingly, metals with already clean surfaces can be directly exposed to the conversion treatment bath without further processing. However, when the metal surface is contaminated by adhering iron powder, dust, oil, or the like, the surface contaminants must be removed by a cleaning process such as aqueous alkaline degreasing, emulsion degreasing, solvent-based degreasing, and so forth. When a water-based cleaner is used, cleaning is preferably followed by a water rinse station where cleaning solution carried forward on the metal surface is removed.

The zinc phosphate conversion treatment bath employed by the method according to the present invention is essentially an acidic aqueous solution that contains zinc ions, phosphate ions, and organoperoxide. The zinc ions concentration in the conversion treatment bath is generally preferably from 0.5 to 5.0 g/L. An adequate coating weight may not be obtained when the zinc ions concentration is below 0.5 g/L; this leads to a decline in the coverage ratio by the resulting conversion coating on the metal surface and thereby to an inadequate post-painting corrosion resistance. Concentrations in excess of 5.0 g/L can cause a coarsening of the coating crystals, thereby producing in particular a decline in the post-painting paint film adherence.

The phosphate ions concentration in the conversion treatment bath used by the method according to the present invention is preferably from 5.0 to 30.0 g/L. Concentrations below 5.0 g/L can make it difficult to form normal conversion coatings, while concentrations in excess of 30.0 g/L do not provide any additional increments in activity and are therefore uneconomical. The phosphate ions can be formed by the addition of phosphoric acid or its aqueous solutions to the conversion treatment bath or by the dissolution of sodium phosphate, magnesium phosphate, zinc phosphate, or the like in the conversion treatment bath. The stoichiometric equivalent as phosphate ions of all such sources of phosphoric acid, condensed phosphoric acids, and salts of simple or condensed phosphoric acids in the liquid compositions used for conversion coating is to be understood as phosphate ions for the purposes of determining these preferred concentrations, irrespective of the actual degree of ionization that exists in the compositions. Primarily for reasons of economy, orthophosphoric acid and its salts are preferred.

The conversion treatment bath used in the present invention contains at least one organoperoxide. The organoperoxide has oxidizing power, as do many other materials such as nitrite ions that are called "accelerators" and are commonly used in prior art phosphate conversion coating forming compositions. Organoperoxide, unlike previously known accelerators, also functions to induce fine-size crystal formation in the conversion coating. This enables the surface treatment method according to the present invention to form a uniform, thin, finely crystalline, and dense conversion coating in the absence of a titanium colloid surface-conditioning treatment. The use of an organoperoxide-containing conversion treatment bath is the most characteristic feature of the method according to the present invention.

The organoperoxide used in the subject conversion treatment bath is exemplified by organoperoxides, such as tert-butyl hydroperoxide, di-tert-butyl peroxide, acetylacetone peroxide, cumene hydroperoxide, tert-butylperoxymaleic acid, and so forth that have a simple peroxy moiety, and by organoperoxides that have a percarboxylic acid moiety, such as peracetic acid, monoperphthalic acid, persuccinic acid, and so forth. Particularly useful levels of organoperoxide are within the range of 80–1000 ppm. Acceptable performance has been shown with organoperoxide levels of 80, 150, 200, 500, and 1,000 ppm. When the organoperoxide has a low solubility in the treatment bath, its presence in the aforementioned conversion treatment bath can be induced by solubilization through the addition of a relatively small amount of a water-soluble organic solvent or surfactant.

The organoperoxide is preferably added to give a concentration from 50 to 1,500 ppm in the conversion treatment bath. An organoperoxide concentration in the conversion treatment bath below 50 ppm can result in an inadequate acceleration of conversion coating formation and inadequate results in terms of producing fine-size crystals in the coating. Concentrations in excess of 1,500 ppm do not produce any additional increments in results and are therefore uneconomical.

The zinc phosphate conversion treatment bath used by the present invention may also contain etchant, whose function is to generate a uniform etch of the surface of the metal being treated, and non-zinc metal ions, whose function is to provide additional improvements in the painting performance.

Fluoride ions or complex fluoride ions, e.g., fluosilicate ions, can be used as the etchant. Fluorine compounds that produce these ions are exemplified by hydrofluoric acid, fluosilicic acid, and their metal salts (sodium salt, potassium salt), and the etching ions are produced by the dissolution of these compounds in the conversion treatment bath. The etching ions are preferably present in the conversion treatment bath at a concentration from 100 to 2,000 ppm.a Nickel ions, manganese ions, cobalt ions, magnesium ions, calcium ions, and the like can be employed as the non-zinc metal ions additive. Each of these kinds of ions can be formed by dissolution in the conversion treatment bath of an oxide, hydroxide, carbonate, sulfate, phosphate, and/or other compound of the corresponding metal, or even of the elemental metal itself. These metal ions are preferably present in the conversion treatment bath at a concentration from 100 to 2,000 ppm.

The conversion treatment bath used by the present invention need not contain nitric acid, nitrous acid, an organic nitro compound, etc., and in consequence thereof can be formulated as a conversion bath that is completely free of nitrogenous compounds. This nitrogen-free formulation eliminates the need for a nitrogenous compound treatment step during effluent treatment and makes it quite easy for the surface treatment method according to the present invention to accommodate environmental regulations on the effluent levels of nitrogenous compounds.

A preferred treatment sequence in a process according to the present invention comprises, more preferably consists essentially of, or still more preferably consists of the following steps, executed in the given sequence: alkaline degreasing, water rinse, zinc phosphate conversion treatment, and water rinse. The degreasing process and water rinses can in each case be implemented as single-step or multistep processes. The final water rinse is preferably a deionized water rinse. Painting can be carried out after the final water rinse without an intervening drying step or can be carried out after a drying step following the final water rinse.

Zinc phosphate conversion treatment using the surface treatment method according to the present invention is ordinarily run by immersion or spraying or a combination thereof. In practice a satisfactory conversion film can be formed using treatment times (contact time between the metal surface and conversion treatment bath) from approximately 1 minute to approximately 5 minutes. The temperature of the zinc phosphate conversion treatment bath is preferably 25° C. to 50° C.

The functions and effects of the surface treatment method according to the present invention are discussed below with particular reference to the activity in conversion film formation of the organoperoxide present in the zinc phosphate conversion treatment bath used in the present invention.

When the metal workpiece is ferriferous, the organoperoxide used in the method according to the present invention also oxidizes dissolved divalent iron ion to trivalent iron ions, just as do the prior-art inorganic oxidizing agents. This prevents the accumulation of divalent iron ions, which are detrimental to the conversion reactions. The trivalent iron ions afforded by oxidation react with the phosphate ions present in the conversion treatment bath to form an iron phosphate ($FePO_4 \cdot xH_2O$) sludge that is easily removed from the system.

The present invention may be further appreciated by consideration of the working examples and comparative examples of actual treatment as shown below; however, the present invention is not limited to the following examples.

EXAMPLES

The test materials were cold-rolled steel sheet (SPCC-SD, sheet thickness: 0.8 mm), zinc-electroplated steel sheet (sheet thickness: 0.8 mm, plating weight: both surfaces 30 g/m$^2$), galvannealed hot-dip zinc-plated steel sheet (sheet thickness: 0.8 mm, plating weight: both surfaces 45 g/m$^2$), and aluminum-magnesium alloy sheet (A5052, sheet thickness: 1.0 mm). In each case they were cut to 70×150 mm to prepare the specimens that were then subjected to the treatments in the working and comparative examples. Each test material was coated with 2 g/m$^2$ of a commercial cleaning/rust-preventing oil.

The treatment processes common to the working and comparative examples are given below.

(1) degreasing (FINECLEANER® L4460 alkaline degreaser from Nihon Parkerizing Company, Limited, solution in water of 20 grams per liter (hereinafter usually abbreviated as "g/L") of agent A and 12 g/L of agent B) 43° C., 120 seconds of contact time, immersion (2) tap-water rinse ambient temperature, 30 seconds, spray (3) zinc phosphate conversion treatment (Specific conditions are given in the respective working and comparative examples. The treatment time was always 120 seconds.)

(4) tap-water rinse ambient temperature, 30 seconds, spray (5) deionized water rinse (deionized water with a conductivity of 0.2 microSiemens/cm) ambient temperature, 20 seconds, spray (6) drain/dry: hot air at 110° C., 180 seconds Treatment compositions, alternatively called "baths" for brevity, numbered (1) to (3) as described below were used as starting points for the zinc phosphate conversion treatment baths. The type and concentration of organoperoxide or other oxidizing agent, the treatment temperature, and the treatment time are given in the particular working and comparative examples.

Conversion Treatment Bath (1)

Phosphate ions: 15 g/L (from addition of 75% phosphoric acid)

Zinc ions: 1.3 g/L (from addition of zinc oxide)

Nickel ions: 0.5 g/L (from addition of nickel carbonate)

Fluorine component: 1.0 g/L (from addition of sodium fluosilicate)

2-butanol: 30 g/L

Free acidity: 0.6 points (Points of free acidity are defined as the number of milliliters of 0.1N sodium hydroxide solution in water needed to titrate a 10 milliliter sample of the composition to a color change from yellow to blue, using Bromophenol Blue indicator.)

Conversion Treatment Bath (2)

Phosphate ions: 13 g/L (from addition of 75% phosphoric acid)

Zinc ions: 1.1 g/L (from addition of zinc oxide)

Cobalt ions 0.4 g/L (from addition of basic cobalt carbonate)

Fluorine component: 0.4 g/L (from addition of sodium bifluoride)

Free acidity: 0.4 points

Conversion Treatment Bath (3)

Phosphate ions: 17 g/L (from addition of 75% phosphoric acid)

Zinc ions: 1.5 g/L (from addition of zinc oxide)

Free acidity: 0.7 points

Each of conversion treatment baths (1) to (3) was adjusted to the specified free acidity, after adding all other ingredients as shown, by adding sodium hydroxide.

The coating weights were measured as follows. The weight in grams of the treated sheet after conversion treatment was measured to give "W1". The coating was then stripped off the treated sheet using the stripping solution and stripping conditions given below, and the weight in grams of the stripped sheet was measured to give "W2". The coating weight in grams per square meter (hereinafter usually abbreviated as "g/m$^2$") was then calculated using the following equation: coating weight in g/m$^2$=(W1−W2)/0.021

Stripping Conditions (1) For the cold-rolled steel sheet:

stripping solution: 5% aqueous chromic acid stripping conditions: 75 ° C., 15 minutes, immersion (2) For the zinc-electroplated steel sheet and galvannealed hot-dip zinc-plated steel sheet:

stripping solution: 2 weight % of ammonium dichromate +49 weight % of 28 weight % aqueous ammonia +49 weight % of pure water stripping conditions: room temperature, 15 minutes, immersion (3) For the aluminum alloy sheet stripping solution: 5% aqueous chromic acid stripping conditions: room temperature, 5 minutes, immersion The deposited coating crystals were inspected with a scanning electron microscope (hereinafter usually abbreviated as "SEM") at 1,000. This magnified image was used to evaluate base metal coverage (presence/absence of exposed substrate) and to measure the particle size of the conversion coating crystals for evaluation of the extent of fine-size crystals.

The following standards were used for reporting the base metal coverage and the extent of fine-size crystals.

(1) Standards for evaluation of the crystal particles cold-rolled steel sheet:

+ less than 35 micrometers

× greater than or equal to 35 micrometers zinc-electroplated steel sheet:

+ less than 25 micrometers

× greater than or equal to 25 micrometers galvannealed hot-dip zinc-plated steel sheet:

+ less than 30 micrometers

× greater than or equal to 30 micrometers aluminum alloy sheet:

+ less than 30 micrometers

× greater than or equal to 30 micrometers (2) Standard for evaluation of the base metal coverage For all specimens:

+ absolutely no exposure of base metal observed

× some exposure of the base metal observed

Conversion-treated test panels were electrodeposition painted using a cationic electrodeposition paint (Elecron™ 2000 from Kansai Paint Kabushiki Kaisha) to give a paint film with a film thickness of 20 micrometers. These painted specimens were then subjected to the following painting performance tests in order to evaluate the painting performance.

(1)Test of the post-painting corrosion resistance

A cut was introduced into the paint film on the painted sample. The painted sample was thereafter immersed for 240 hours in 5% aqueous sodium chloride heated to 50 ° C., and then removed, rinsed with water, and dried. The neighborhood of the cut was peeled using cellophane tape, and the maximum width of paint film peeling on one side was measured after the tape peel and reported on the following scale:

+: maximum one-side width of peel is less than 7 millimeters (hereinafter usually abbreviated as "mm");

#: maximum one-side width of peel is at least 7 mm but less than 10 mm;

×: maximum one-side width of peel is at least 10 mm.

(2) Test of the water-resistant secondary adherence

The painted sample was immersed for 240 hours in pure water heated at 40° C. and then removed and dried. A cross was thereafter scribed in the paint film; the center of the cut was extruded 3 mm using an Erichsen tester; and, after a cellophane tape peel, the paint film peel ratio (i.e., the ratio of the peeled area to the extruded area) was measured. The following scale was used for reporting:

+: paint film peel ratio is less than 10%

#: paint film peel ratio is at least 10% but less than 20%

×: paint film peel ratio is at least 20%.

Example 1

Two hundred (200) parts per million by weight (hereinafter usually abbreviated as "ppm") of tert-butyl hydroperoxide was added to Conversion treatment bath (1), which was then used to treat cold-rolled steel sheet by immersion at a treatment temperature of 45° C.

Example 2

Eighty (80) ppm of di-tert-butyl peroxide was added to Conversion treatment bath (1), which was then used to treat zinc-electroplated steel sheet by immersion at a treatment temperature of 45° C.

Example 3

Five hundred (500) ppm of tert-butyl hydroperoxide was added to conversion treatment bath (2), which was then used to treat cold-rolled steel sheet by spraying at a treatment temperature of 40° C.

Example 4

One thousand one hundred (1,100) ppm of acetylacetone peroxide was added to conversion treatment bath (2), which was then used to treat zinc-electroplated steel sheet by immersion at a treatment temperature of 40° C.

Example 5

Five hundred (500) ppm of di-tert-butyl peroxide was added to conversion treatment bath (1), which was then used to treat cold-rolled steel sheet by immersion at a treatment temperature of 43° C.

Example 6

Five hundred (500) ppm of tert-butyl hydroperoxide was added to conversion treatment bath (3), which was then used to treat galvannealed hot-dip zinc-plated steel sheet by spraying at a treatment temperature of 33° C.

Example 7

One hundred fifty (150) ppm of di-tert-butyl peroxide was added to conversion treatment bath (1), which was then used to treat aluminum-magnesium alloy sheet by spraying at a treatment temperature of 43° C.

Comparative Example 1

Two hundred (200) ppm of sodium nitrite was added to conversion treatment bath (1), which was then used to treat cold-rolled steel sheet by immersion at a treatment temperature of 43° C.

Comparative Example 2

Cold-rolled steel sheet was treated by immersion in conversion treatment bath (1) heated to 43° C.

Comparative Example 3

Two thousand (2,000) ppm of sodium chlorate was added to conversion treatment bath (2), which was then used to treat zinc-electroplated steel sheet by immersion at a treatment temperature of 40° C.

Comparative Example 4

Galvannealed hot-dip zinc-plated steel sheet was sprayed with conversion treatment bath (3) heated to 33° C.

Comparative Example 5

Aluminum-magnesium alloy sheet was sprayed with conversion treatment bath (1) heated to 43° C.

The treatment conditions and test results for all of the Examples are reported in Tables 1 and 2 respectively and the treatment conditions and test results for all of the Comparative Examples are reported in Tables 3 and 4 respectively.

TABLE 1

| Identification | Metal Coated | Concentration in the Conversion Coating Bath, g/L of: Phosphate Ions | Zinc Ions | Other Metal Ions | Oxidizing Agent Type | Ppm | Fluorine Concentration, g/L | Points of Free Acidity in Conversion Coating Bath | Temperature in °C. during Conversion Coating | Contact Technique |
|---|---|---|---|---|---|---|---|---|---|---|
| E 1 | CRS | 15 | 1.3 | Ni:0.5 | A | 200 | 1 | 0.6 | 45 | Im |
| E 2 | EG | 15 | 1.3 | Ni:0.5 | B | 80 | 1 | 0.6 | 45 | Im |
| E 3 | CRS | 13 | 1.1 | Co:0.4 | A | 500 | 0.4 | 0.4 | 40 | Sp |
| E 4 | EG | 13 | 1.1 | Co:0.4 | C | 1100 | 0.4 | 0.4 | 40 | Im |
| E 5 | CRS | 15 | 1.3 | Ni:0.5 | B | 500 | 1 | 0.6 | 43 | Im |
| E 6 | GA | 17 | 1.5 | — | A | 500 | — | 0.7 | 33 | Sp |
| E 7 | AL | 15 | 1.3 | Ni:0.5 | B | 150 | 1 | 0.6 | 43 | Sp |

Abbreviations for Table 1
E = Example; CRS = cold-rolled steel sheet; EG = galvanized steel sheet; GA = galvannealed hot-dip zinc-plated steel sheet; AL = aluminum-magnesium alloy sheet; A = tert-butyl hydroperoxide; B = di-tert-butyl peroxide; C = acetylacetone peroxide; Im = Immersion; Sp = Spray

TABLE 2

| Identification | Coating Mass, g/m$^2$ | Test Score for Test of: Crystal Size | Base Metal Coverage | Post-Painting Corrosion Resistance | Water Resistant Secondary Adherence |
|---|---|---|---|---|---|
| Example 1 | 0.9 | + | + | + | + |
| Example 2 | 3.5 | + | + | + | + |
| Example 3 | 1.2 | + | + | + | + |
| Example 4 | 3.2 | + | + | + | + |
| Example 5 | 1.3 | + | + | + | + |

TABLE 2-continued

| Identification | Coating Mass, g/m$^2$ | Test Score for Test of: Crystal Size | Base Metal Coverage | Post-Painting Corrosion Resistance | Water Resistant Secondary Adherence |
|---|---|---|---|---|---|
| Example 6 | 4.3 | + | + | # | + |
| Example 7 | 2.5 | + | + | + | + |

TABLE 3

| Identification | Metal Coated | Concentration in the Conversion Coating Bath, g/L of: Phosphate Ions | Zinc Ions | Other Metal Ions | Oxidizing Agent Type | Ppm | Fluorine Concentration, g/L | Points of Free Acidity in Conversion Coating Bath | Temperature in °C. during Conversion Coating | Contact Technique |
|---|---|---|---|---|---|---|---|---|---|---|
| C 1 | CRS | 15 | 1.3 | Ni:0.5 | D | 200 | 1.0 | 0.6 | 43 | Im |
| C 2 | CRS | 15 | 1.3 | Ni:0.5 | — | — | 1.0 | 0.6 | 43 | Im |
| C 3 | EG | 13 | 1.1 | Co:0.4 | E | 2000 | 0.4 | 0.4 | 40 | Im |
| C 4 | GA | 17 | 1.5 | — | — | — | — | 0.7 | 33 | Sp |
| C 5 | AL | 15 | 1.3 | Ni:0.5 | — | — | 1.0 | 0.6 | 43 | Sp |

Abbreviations for Table 3
C = Comparison Example; CRS = cold-rolled steel sheet; EG = galvanized steel sheet; GA = galvannealed hot-dip zinc-plated steel sheet; AL = aluminum-magnesium alloy sheet; D = sodium nitrate; E = sodium chlorate; Im = Immersion; Sp = Spray.

TABLE 4

| Identification | Coating Mass, g/m$^2$ | Test Score for Test of: Crystal Size | Base Metal Coverage | Post-Painting Corrosion Resistance | Water Resistant Secondary Adherence |
|---|---|---|---|---|---|
| Comp. Ex. 1 | 4.0 | x | x | # | x |
| Comp. Ex. 2 | 0.5 | x | x | x | # |
| Comp. Ex. 3 | 5.2 | x | + | # | x |
| Comp. Ex. 4 | 7.3 | x | + | x | x |
| Comp. Ex. 5 | 1.3 | x | x | x | # |

Examples 1 to 7, which employed the surface treatment method according to the present invention, consisted of treatment using a conversion treatment bath that contained organoperoxide as the oxidizing agent (see Table 1). In each case this resulted in the deposition of a thin, uniform, finely crystalline, and dense zinc phosphate conversion coating on the surface of the metal workpiece and in an excellent painting performance (post-painting corrosion resistance and water-resistant secondary adherence). In Comparative Examples 2, 4, and 5, treatment was carried out using a conversion treatment bath that was entirely free of oxidizing agent. In contrast to the examples, the oxidizing activity in these comparative examples was inadequate, only coarse coating crystals were deposited, and the base metal was not uniformly covered. Comparative Examples 1 and 3 employed, respectively, a nitrite salt and chlorate salt, which are the oxidizing agents most typically used in the prior art. Finely crystalline, dense films were not deposited in these comparative examples and a satisfactory painting performance was therefore not obtained.

Benefits of the Invention

The surface treatment method according to the present invention is able to deposit a uniform, finely crystalline, and dense zinc phosphate conversion coating on metals. This coating has an excellent painting performance, as expressed in terms of the post-painting corrosion resistance and water-resistant secondary adhesion. Moreover, the subject surface treatment method is able to do this through a very simple procedure of cleaning (degreasing)—conversion treatment—water rinse. Accordingly, the surface treatment method according to the present invention does not require the surface-conditioning treatment indispensable in the prior art for the deposition of a uniform, thin, finely crystalline, and dense conversion coating. The surface treatment method according to the present invention is thus quite revolutionary in that it makes possible simplification of the treatment facilities, frees the processor from a complicated management of the conversion treatment bath, and offers the economic advantage of no requirement for surface-conditioning agent.

The invention claimed is:

1. An aqueous liquid composition for forming a zinc phosphate conversion coating on a metal surface by contact therewith, said composition consisting essentially of water, zinc ions; phosphate ions; floutine from flouide ions, complex fluoride ions, or both; and at least one organoperoxide in amounts effective to form a uniform, thin, finely crystalline, and dense conversion coating when applied to a titanium-free metal surface at a temperature within the range of 25°–50° C.

2. An aqueous liquid composition according to claim 1, wherein the organoperoxide concentration is from 50 to 1,500 ppm.

3. An aqueous liquid composition according to claim 2, wherein said organoperoxide has a peroxy moiety.

4. An aqueous liquid composition according to claim 1, wherein the zinc ion concentration is from 0.5 to 5.0 g/L.

5. An aqueous liquid composition according to claim 3, wherein said organoperoxide has percarboxylic acid moiety.

6. An aqueous liquid composition according to claim 1, wherein the phosphate ion concentration is from 5.0 to 30.0 g/L.

7. An aqueous liquid composition according to claim 1, which includes from 100 to 2,000 ppm of fluorine from fluoride ions, complex fluoride ions, or both.

8. An aqueous liquid composition according to claim 5, further including a total; of from 100 to 2,000 ppm of divalent metal cations selected from the group consisting of nickel, manganese, cobalt, magnesium, and calcium cations.

9. An aqueous liquid composition according to claim 1 which includes a total of from 100 to 2,000 ppm of divalent metal cations selected from the group consisting of nickel, manganese, cobalt, magnesium, and calcium cations.

10. A composition according to claim 1 wherein said organoperoxide is selected from the group consisting of t-butyl hydroperoxide, di-t-butyl peroxide, acetylacetone peroxide, cumene hydroperozide, t-butyl peroxymaleic acid, peracetic acid, monoperphthalic acid, and persuccinc acid.

11. A composition according to claim 10 wherein said organoperoxide is selected from the group consisting of t-butyl hydroperoxide, di-t-butyl peroxide, and acetylacetone peroxide.

12. A conversion coating composition free of nitrogenous compounds and titanium compounds, wherein said composition comprises:

0.5–5 g/l of zinc ions,

5–30 g/l of phosphate ions,

100–2000 ppm of an etchant containing fluoride ions, and

50–1500 ppm of an organoperoxide selected tom the group consisting of t-butyl hydroperoxide, di-t-butyl peroxide, acetylacetone peroxide, cumene hydroperoxide, t-butyl peroxymaleic acid, peracetic acid, monoperphthalic acid, and persuccinic acid.

13. A process of forming a phosphate conversion coating on a metal surface, said process comprising steps of:

(I) cleaning the metal surface, and optionally, rinsing and/or drying the surface to form a cleaned titanium-free surface; and (II) contacting said cleaned, titanium-free surface with an aqueous liquid composition consisting essentially of water, zinc ions, phosphate ions, fluoride ions, and at least one organoperoxide in amount effective to form a uniform, thin finely crystalline, and dense conversion coating when applied to a titanium-free metal surface at a temperature within the range of 25°–50°C.

14. A process according to claim 13, wherein step (II) is performed at a temperature from 25° to 50° C. for a time from 1 to 5 minutes.

15. A process according to claim 14, wherein the metal surface cleaned in step (I) is rinsed with water before step (II) and after step (II) the metal surface is removed from the contact established in step (II) and rinsed with deionized water.

16. A process according to claim 13, wherein said aqueous liquid composition further includes a total of from 100 to 2,000 ppm of divalent metal cations selected from the group consisting of nickel, manganese, cobalt , magnesium, and calcium cations.

17. A process according to claim 16, wherein step (II) is performed at a temperature from 25° to 50° C. for a time from 1 to 5 minutes.

18. A process according to claim 17, wherein the metal surface cleaned in step (I) is rinsed with water before step (II), and after step (II) the metal surface is removed from the contact established in step (II) and rinsed with deionized water.

19. A process according to claim 13, wherein said aqueous liquid composition further includes 100 to 2,000 ppm of fluorine from fluoride ions, complex fluoride ions or both.

20. A process according to claim 19, wherein step (II) is performed at a temperature from 25 to 50° C. for a time from 1 to 5 minutes.

21. A process according to claim 13 wherein said aqueous liquid composition has a phosphate ion concentration within the range of 5.0 to 30.0 g/L.

22. A process according to claim 13, wherein said aqueous liquid composition has a zinc ion concentration within the range of 0.5 to 5.0 g/L.

23. A process according to claim 13 wherein said aqueous liquid composition further includes an organoperoxide selected from the group consisting of t-butyl hydroperoxide, di-t-butyl peroxide, acetylacetone peroxide, cumene hydropetoxide, t-butyl peroxymaleic acid, peracetic acid, monoperphthalic acid, and persuccinic acid.

* * * * *